US005078860A

United States Patent [19]

Ray et al.

[11] Patent Number: 5,078,860

[45] Date of Patent: Jan. 7, 1992

[54] SEQUENTIAL AND SELECTIVE FLOTATION OF SULFIDE ORES CONTAINING COPPER AND MOLYBDENUM

[75] Inventors: Harold M. Ray, Potosi; John C. Morrisey, IV, Viburnum, both of Mo.

[73] Assignee: The Doe Run Company, St. Louis, Mo.

[21] Appl. No.: 651,315

[22] Filed: Feb. 6, 1991

[51] Int. Cl.[5] ..... B03D 1/06; B03D 1/08; B03D 1/016; B03D 1/002

[52] U.S. Cl. ..... 209/167; 252/61

[58] Field of Search ..... 209/166, 167; 252/61

[56] References Cited

U.S. PATENT DOCUMENTS

| | | | |
|---|---|---|---|
| 2,070,076 | 2/1937 | Brown | 209/167 |
| 2,664,199 | 12/1953 | Barker et al. | 209/167 |
| 2,811,255 | 10/1957 | Nokes | 209/167 |
| 4,339,331 | 7/1982 | Lim | 209/167 |
| 4,514,292 | 4/1985 | Burdick | 209/167 |
| 4,549,959 | 10/1985 | Armstrong | 209/167 |
| 4,877,517 | 10/1989 | Bulatovic | 209/167 |

OTHER PUBLICATIONS

Joseph F. Shirley, "By-Product Molybdenite," Mar. 1; 1978.

Joseph F. Shirley, "State-of-the-Art By-Product Molybdenite Recovery," Sep. 1981.

*Primary Examiner*—Stanley S. Silverman
*Assistant Examiner*—Thomas M. Lithgow
*Attorney, Agent, or Firm*—Armstrong, Teasdale, Schlafly & Davis

[57] ABSTRACT

A sequential flotation process for the separation of components of an ore containing sulfides of copper and molybdenum involves initially effecting selective flotation of the copper component directly from the ore by conditioning the ore with a combination of a source of bisulfite ion and causticized starch to produce a conditioned ore having a pH between approximately 5.2 and 6.2, and thereafter treating the conditioned ore with a collector selected from the group consisting of dialkyl dithiophosphates and alkyl dithiophosphinates.

12 Claims, 1 Drawing Sheet

REAGENT ADDITION POINTS:

1 SULFUR DIOXIDE
2 STARCH
3 DITHIOPHOSPHATE
4 FROTHER
5 AC3302
6 KEROSINE
7 PINE OIL
8 ZnCN

REAGENT ADDITION POINTS:

| | | | |
|---|---|---|---|
| 1 | SULFUR DIOXIDE | 5 | AC3302 |
| 2 | STARCH | 6 | KEROSINE |
| 3 | DITHIOPHOSPHATE | 7 | PINE OIL |
| 4 | FROTHER | 8 | ZnCN |

SEQUENTIAL AND SELECTIVE FLOTATION OF SULFIDE ORES CONTAINING COPPER AND MOLYBDENUM

BACKGROUND OF THE INVENTION

This invention relates to sequential flotation of sulfide ores and, more particularly, to the sequential and selective initial flotation of the copper component directly from ores containing copper sulfide and the sulfides of other metals such as molybdenum.

Western United States porphyry ores contain copper sulfide and molybdenite or molybdenum sulfide as well as the sulfides of other metals. Many operations have been developed for recovering the molybdenite from the copper concentrate by a number of different separation processes. Typically, the majority of existing copper-molybdenum processes first float a combined copper-molybdenum bulk concentrate using a lime circuit and then employ one or more processes to separate the copper and molybdenum. These various processes may include steam or roasting heat treatment, the use of reagents such as sodium ferro and/or ferricyanide, sulfide reagents and arsenic or phosphorous Nokes' reagent, hypochlorite or hydrogen peroxide oxidation, long conditioning periods or bulk concentrate aging, and other methods coupled with many stages of cleaning.

Thus, sodium hydrosulfide, sodium sulfide or ammonium sulfide are used to depress the copper sulfides while floating molybdenite with a hydrocarbon oil. Nokes' reagents, which are thiophosphorous or thioarsenic compounds, have been widely used in the separation of molybdenite from copper, causing depression of copper minerals. In this process, the bulk copper-molybdenum concentrate is treated with the depressant to inhibit flotation of the copper and iron sulfides, while the molybdenite is floated with a hydrocarbon oil and a frother. Oxidizing agents such as hypochlorite or permanganate have been used with the final stages of upgrading of the molybdenite concentrate requiring the additional use of ferrocyanide, sodium cyanide, or a zinc-cyanide complex. The combination of hypochlorite and sodium ferrocyanide has been used as has hydrogen peroxide in conjunction with sodium ferrocyanide. A steaming process has been used whereby the copper-molybdenum bulk concentrate after thickening is steamed at atmospheric or higher pressures to strip the collector coatings from the mineral particles. This is followed by flotation using ferrocyanide for additional depression of the copper sulfides, with a light hydrocarbon oil and an alcohol frother used to recover the molybdenite. Roasting has been used for removal of collector coating and superficial oxidation of the copper sulfide surfaces. Dextrin and starch have been used to depress the molybdenite while floating the copper sulfides.

U.S. patents concerned with the recovery of molybdenite from copper sulfide-molybdenite concentrates include U.S. Pat. Nos. 2,664,199 and 2,811,255.

There remains a need for improved methods for the direct flotation of copper from ores containing the sulfides of copper, molybdenum and other minerals and, in particular, for effecting a primary selective flotation of copper by direct treatment of such ores rather than by the initial formation of a bulk copper-molybdenum concentrate.

SUMMARY OF THE INVENTION

Among the objects of the present invention may be noted the provision of an improved flotation process for initially effecting selective flotation of the copper component of ores containing sulfides of copper, molybdenum and other minerals; the provision of such an improved process which permits advantageous economies in reagent use to be realized; the provision of an improved flotation process wherein the use of lime as a reagent is avoided; the provision of such a process which effects the selective and economical recovery of copper directly from a copper sulfide-molybdenite ore; the provision of a process of the type described which permits the use of existing equipment; and the provision of such a process which optimizes the recovery of copper and molybdenum values from ores containing sulfides of these minerals. Other objects will be in part apparent and in part pointed out hereinafter.

Briefly, the present invention is directed to an improvement in a sequential flotation process for the separation of components of an ore containing sulfides of copper and molybdenum wherein the ore is routed sequentially through a series of flotation circuits having separation and concentration stages for separating and concentrating the components of the ore, the improvement comprising initially effecting selective flotation of the copper component directly from the ore by conditioning the ore with a combination of a source of bisulfite ion and causticized starch to produce a conditioned ore having a pH between approximately 5.2 and 6.2, and thereafter treating the conditioned ore with an alkyl dithiophosphinate or dialkyl dithiophosphate collector.

In the practice of the invention a process is provided for selectively and sequentially recovering a copper concentrate and a molybdenum concentrate from an ore containing sulfides of copper and molybdenum and being substantially free of soluble copper compounds which involves the steps of:

(a) grinding a mixture of the ore and water to produce a slurry;

(b) conditioning the slurry with a combination of a source of bisulfite ion and causticized starch to depress molybdenum and promote copper flotation, the conditioned slurry having a pH between approximately 5.2 and 6.2;

(c) adding to the conditioned ore a frother and a collector selected from the group consisting of alkyl dithiphosphinates and dialkyl dithiophosphates;

(d) subjecting the conditioned ore to froth flotation to produce a copper rougher concentrate;

(e) conditioning the copper rougher concentrate with starch to depress molybdenum and cleaning the conditioned copper rougher concentrate to produce a copper concentrate;

(f) conditioning the tailing from the froth flotation in step (d) with a molybdenum collector to produce a molybdenum rougher concentrate;

(g) conditioning the .tailing from the molybdenum rougher concentrate with kerosene, pine oil and a molybdenum collector, floating another portion of the molybdenum rougher concentrate with a frother, and combining the resulting froths; and (h) cleaning the combined froths to produce a final molybdenum concentrate.

DESCRIPTION OF THE PREFERRED EMBODIMENTS

Figure 1:
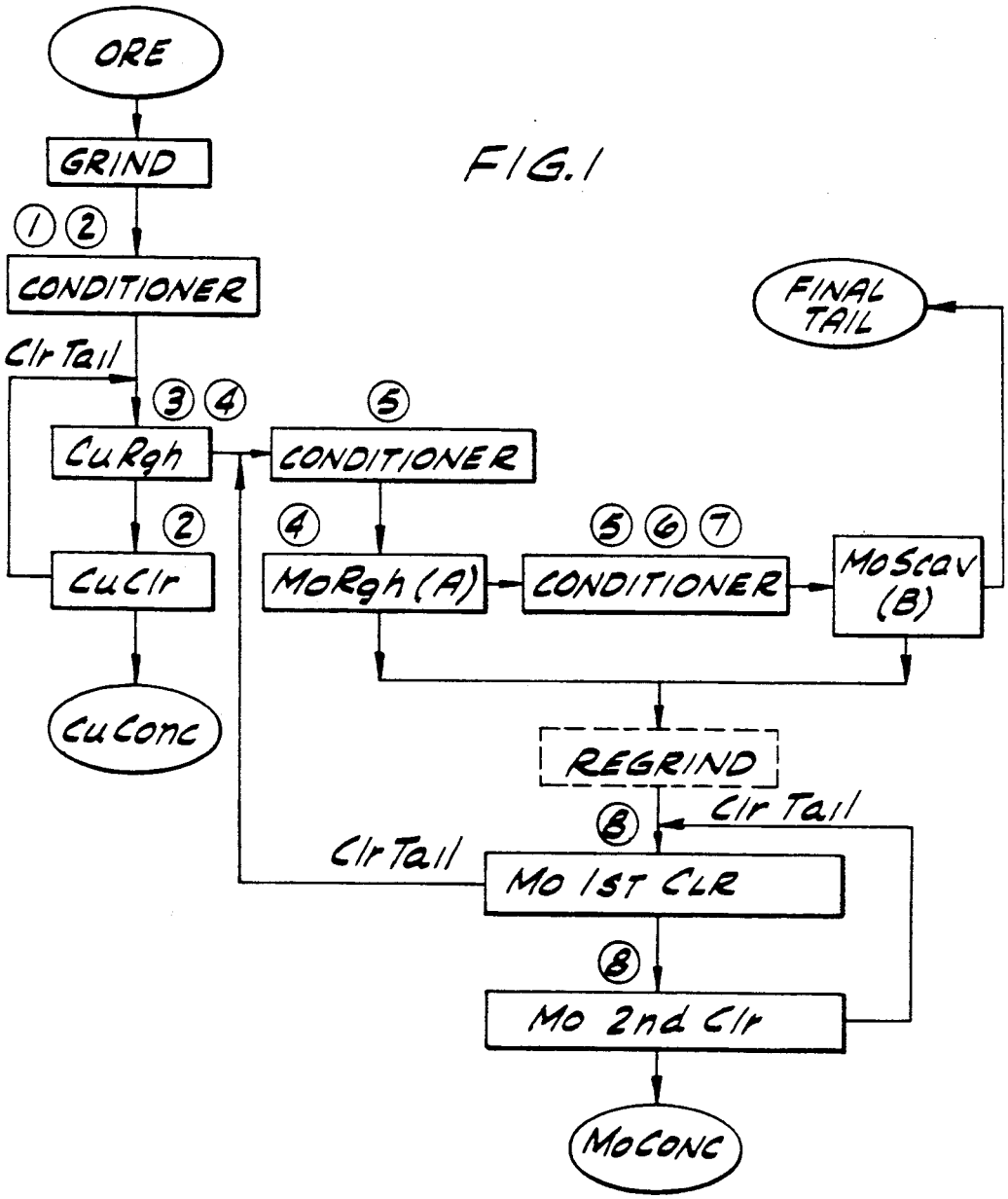
FIG. 1 is a flowsheet of a selective and sequential flotation process according to the present invention.

In accordance with the present invention it has now been found that the copper component of copper and molybdenum sulfide containing ores may be directly separated from such ores through selective flotation by conditioning the ore with a combination of a source of a bisulfite ion and causticized starch to produce a conditioned ore having a pH between approximately 5.2 and 6.2, and thereafter treating the conditioned ore with a dialkyl dithiophosphate or alkyl dithiophosphinate collector. Through the use of these conditions, the necessity for first effecting a primary flotation of a bulk copper-molybdenum concentrate is avoided and a selective flotation between copper and molybdenum directly is made possible. In addition, by the use of such optimum conditions, the present invention achieves maximum selectivity, avoids the use of lime, permits economies in reagent usage and eliminates the requirements for an elevated pH for pyrite depression. Further, the present invention significantly reduces the number of cleaning stages needed to obtain saleable copper and molybdenum concentrates and eliminates the use of expensive, time-consuming and hazardous steps required to effect a copper-molybdenum separation from a bulk concentrate. Finally, the process of the present invention achieves increased molybdenum recovery into a saleable concentrate while maintaining copper recoveries in excess of 90%.

The selective initial flotation of copper directly from copper and molybdenum sulfide containing ores is carried out at a pH between approximately 5.2 and 6.2, preferably between approximately 5.2 and 5.6. These pH values are achieved by conditioning a slurry of the copper/molybdenum ore and water with a combination of a source of a bisulfite ion and causticized starch. It is believed that the concentration of the bisulfite ion is important to the selective flotation according to the present invention, and that the pH is an indicator of bisulfite ion concentration. A preferred source of bisulfite ion is sulfur dioxide, but other sources of bisulfite ion such as sulfurous acid and alkali metal salts of sulfites, bisulfites and meta bisulfite may also be employed. Typically, between approximately 2 and 6 pounds per ton of ore of sulfur dioxide in the form of a 2.5% sulfur dioxide solution may be utilized in the practice of the invention as a convenient source of bisulfite ion. Of course, other sources of bisulfite ion may also be used, such as, for example, liquid or gaseous sulfur dioxide. The causticized starch for use in the invention may be prepared by dispersing 25 grams of starch, such as that marketed under the trade designation "Stazyme JT" by A. E. Staley Manufacturing Company in 1000 ml of water and then adding 5 grams of sodium hydroxide beads to produce a 2.5% strength solution of causticized starch. Other alkali metal hydroxides may also be employed in the preparation of the causticized starch reagent. In actual practice in the mill, the strengths of the starch solutions used in the practice of the invention may be greater. Typically, the amount of causticized starch used in the practice of the invention may range between approximately 0.2 and 0.5 pounds per ton of ore.

After the ore has been conditioned with a combination of a source of bisulfite ion and causticized starch and the proper pH value has been achieved as described, the conditioned ore is treated with either a dialkyl dithiophosphate collector or, less preferably, with an alkyl dithiophosphinate collector. The preferred collector for use in the invention is a mixture or blend of diisobutyl, diisoamyl and di n-pentyl dithiophosphates such as that marketed by The Lubrizol Corporation under the trade designation "Flotezol 150". Also useful as a collector is a blend of diisobutyl, diisoamyl and diamyl dithiophosphates such as that marketed under the trade designation "S6865" by American Cyanamid Co. or a blend of diisobutyl and diisoamyl dithiophosphates. A useful alkyl dithiophosphinate is that marketed under the trade designation "3418A" by American Cyanamid Co. The amount of collector employed is dependent upon the copper content of the ore being treated, but may typically range from between approximately 0.034 and 0.102 or more pounds per ton of ore.

Thus, the use of the above-described conditions has been found to maximize and optimize the selective flotation of the copper component directly from ores containing copper and molybdenum sulfides, and the present invention provides significant advantages in the selective flotation of copper directly from such ores with enhanced recovery of molybdenum.

FIG. 1 is a flowsheet showing the detailed practice of the invention as applied to ores containing sulfides of copper and molybdenum such as western United States porphyry ores containing significant amounts of copper. As shown, a mixture of the ore and water is first ground to produce a slurry. The resulting slurry is then conditioned with a combination of a source of bisulfite ion, such as $SO_2$, and causticized starch to produce a conditioned ore having a pH between approximately 5.2 and 6.2, preferably between 5.2 and 5.6. The conditioned ore is then treated with one of the above-noted collectors and a frother to effect flotation of a copper rougher concentrate. Various frothers known to the art, such as methyl isobutyl carbinol and polyglycol ethers, may be used. The copper rougher concentrate is then cleaned by conditioning it with causticized starch to enhance the depression of molybdenum and flotation of a copper concentrate is effected with a frother which may, for example, be constituted by a mixture of methyl isobutyl carbinol and polyglycol ether.

The tailing from the copper rougher flotation stage is conditioned with a molybdenum collector, such as an allyl amyl xanthic ester collector marketed under the trade designation "AC3302" by American Cyanamid C. or other known molybdenum collectors, and a frother to produce a molybdenum rougher concentrate A. For the molybdenum rougher stages, molybdenum rougher concentrate A is conditioned with a molybdenum collector, such as a xanthic ester collector, and molybdenum rougher B as shown is conditioned with the same collector, kerosene and pine oil. The combined molybdenum rougher concentrate froths A and B are then cleaned twice with zinc cyanide or other known copper depressants to depress residual copper and to produce a final molybdenum concentrate.

The following examples illustrate the practice of the invention.

EXAMPLE 1

A 1000 gram ore sample with 500 cc of water (approximately 67% solids) was ground for eight minutes in a Denver Equipment Co. laboratory rod/ball mill charged with rods. This resulted in a screen distribution of 85 to 90% minus 200 mesh. After Washing the ground material from the mill, the slurry was conditioned in a Denver Equipment Co. 500 gram stainless steel cell at 1350 rpm and about 30 to 40% solids. Conditioning was carried out with a 2.5% strength sulfur dioxide solution (80 to 90 cc) and causticized starch (5 cc) for four minutes. The causticized starch was prepared by first dispersing 25 grams starch in 500 cc of dilution water and then adding 5 grams of sodium hydroxide beads. The solution was stirred until it changed from a milky white to a translucent liquid. A final 500 cc of water was added to produce a 2.5% strength causticized starch solution.

The initial pH of the slurry was approximately 7.3. Between about 3 to 5 pound $SO_2$ per ton of ore (4.5 lb/ton in this example) are required to achieve a conditioned slurry with a pH between approximately 5.2 and 6.2, with the causticized starch additions usually being about 0.25 pound starch per ton of ore or within the range of approximately 0.25 to 1.00 pound per ton of ore (5 to 20 cc).

Following the conditioning stage, a collector consisting of a blend of diisobutyl, diisoamyl and di n-pentyl dithiophosphates (e.g. the "Flotezol 150" reagent, 0.034 lb/ton of ore) was added together with the frother constituted by a mixture of methyl isobutyl carbinol and a polyglycol ether (3:1mixture, 0.087 lb/ton of ore) to produce a recoverable froth. After a period of about 30 seconds to provide adequate time for reagent dispersion, a copper rougher concentrate was recovered.

To clean the copper rougher concentrate, the froth product was transferred to a 250 gram cell and conditioned for one minute with causticized starch (0.05 lb/ton of ore) and with a frother (0.058 lb/ton of ore of a 3:1 mixture of methyl isobutyl carbinol and a polyglycol ether) at about 1100 rpm following which the copper cleaner concentrate froth was collected to produce a copper concentrate as shown in FIG. 1.

The tailing from the copper rougher flotation stage still in the 500 gram cell was conditioned for one minute with a molybdenum collector (0.061lb/ton of ore of "AC3302" allyl amyl xanthic ester collector) and then floated with a frother (0.046 lb/ton of ore of a polyglycol ether) for three minutes to produce molybdenum rougher concentrate A. The tailing from molybdenum rougher concentrate A was then conditioned for one minute with a molybdenum collector (0.061 lb/ton of ore of "AC3302" allyl amyl xanthic ester collector), kerosene (0.051 lb/ton of ore) and pine oil (0.036 lb/ton of ore) and the froth collected for three minutes to produce molybdenum rougher concentrate B. The combined molybdenum rougher concentrate froths A and B are then cleaned twice by being first transferred to a 250 gram cell, diluted to volume, conditioned for one minute each cleaning circuit with zinc cyanide (0.16 lb/ton of ore) to enhance depression of residual copper and pyrite and then floated for two minutes at 1100 rpm to produce a final molybdenum concentrate.

The following Table I sets forth the results obtained from employing the above-described procedures:

TABLE I

| PRODUCT | GRAMS | WEIGHT % | ANALYSIS % Cu | Fe | Mo | % DISTRIBUTION Cu | Fe | Mo |
|---|---|---|---|---|---|---|---|---|
| Cu conc | 18.90 | 1.9 | 31.40 | 13.80 | 0.18 | 90.55 | 23.81 | 4.31 |
| Cu cir tail | 36.50 | 3.7 | 0.63 | 1.50 | 0.13 | 3.51 | 5.00 | 5.87 |
| Mo conc | 1.10 | 0.1 | 0.39 | 0.90 | 53.09 | 0.07 | 0.09 | 73.38 |
| Mo 1st cir tail | 52.80 | 5.3 | 0.26 | 1.30 | 0.10 | 2.09 | 6.27 | 6.50 |
| Mo 2nd cir tail | 4.60 | 0.5 | 0.62 | 1.90 | 0.73 | 0.44 | 0.80 | 4.22 |
| Tail | 877.00 | 88.5 | 0.03 | 0.80 | 0.005 | 3.35 | 64.04 | 5.73 |
| | | 0.0 | | | | 0.00 | 0.00 | 0.00 |
| | | 0.0 | | | | 0.00 | 0.00 | 0.00 |
| | | 0.0 | | | | 0.00 | 0.00 | 0.00 |
| | | 0.0 | | | | 0.00 | 0.00 | 0.00 |
| | | 0.0 | | | | 0.00 | 0.00 | 0.00 |
| CALCULATED HEAD | 990.90 | | 0.661 | 1.106 | 0.080 | 100.00 | 100.00 | 100.00 |

Example 1 was repeated except that following the initial conditioning stage, a collector consisting of a blend of diisobutyl, diisoamyl and di n-pentyl dithiophosphates (marketed under the trade designation "Flotezol 150" by The Lubrizol Corporation) was used in producing a copper rougher concentrate at the rate of 0.045 lb/ton of ore.

The following Table II sets forth the results obtained:

TABLE II

| PRODUCT | GRAMS | WEIGHT % | ANALYSIS % Cu | Fe | Mo | | | % DISTRIBUTION Cu | Fe | Mo |
|---|---|---|---|---|---|---|---|---|---|---|
| Cu conc | 21.10 | 2.1 | 22.60 | 10.50 | 0.11 | | | 73.15 | 20.24 | 2.87 |
| Cu cir tail | 66.10 | 6.7 | 1.90 | 1.60 | 0.10 | | | 19.26 | 9.66 | 8.06 |
| Mo conc | 1.50 | 0.2 | 0.42 | 1.40 | 39.51 | | | 0.10 | 0.19 | 76.10 |
| Mo 1st cir tail | 46.90 | 4.7 | 0.31 | 1.50 | 0.07 | | | 2.23 | 6.43 | 4.16 |
| Mo 2nd cir tail | 7.00 | 0.7 | 1.26 | 2.20 | 0.25 | | | 1.35 | 1.41 | 2.27 |
| Tail | 849.20 | 85.6 | 0.03 | 0.80 | 0.01 | | | 3.91 | 62.07 | 6.54 |
| | | 0.0 | | | | | | 0.00 | 0.00 | 0.00 |
| | | 0.0 | | | | | | 0.00 | 0.00 | 0.00 |
| | | 0.0 | | | | | | 0.00 | 0.00 | 0.00 |
| | | 0.0 | | | | | | 0.00 | 0.00 | 0.00 |
| | | 0.0 | | | | | | 0.00 | 0.00 | 0.00 |
| CALCULATED HEAD | 991.80 | | 0.657 | 1.104 | 0.079 | 0.00 | 0.00 | 100.00 | 100.00 | 100.00 |

EXAMPLE 3

Example 2 was repeated using a copper-molybdenum ore from the southwest United States. As indicated in the following Table III, a series of 15 test runs were made using various amounts of $SO_2$, starch and "Flotezol 150" as a collector. The results obtained are set forth in Table III:

TABLE III

| Test No. | REAGENTS-LBS PER TON ORE SO2 | Starch | Flotezol 150 | Cu Flot pH | METAL DISTRIBUTIONS % Cu in Cu Rgh | % Cu in Mo Rghs | % Cu in Tail | % Mo in Mo Rghs | % Mo in Cu Rgh | % Mo in Tail |
|---|---|---|---|---|---|---|---|---|---|---|
| 1 | 2.0 | 0.125 | 0.034 | 5.6 | 92.75 | 3.59 | 3.66 | 51.09 | 41.41 | 7.50 |
| 2 | 6.0 | 0.125 | 0.045 | 5.0 | 91.97 | 4.38 | 3.64 | 76.77 | 13.89 | 9.36 |
| 3 | 6.0 | 0.500 | 0.034 | 5.1 | 91.14 | 4.93 | 3.93 | 62.38 | 8.57 | 29.05 |
| 4 | 2.0 | 0.500 | 0.045 | 5.5 | 69.58 | 6.84 | 3.57 | 67.05 | 24.87 | 8.09 |
| 5 | 2.0 | 0.125 | 0.102 | 5.4 | 91.45 | 5.19 | 3.35 | 48.49 | 44.86 | 6.65 |
| 6 | 6.0 | 0.125 | 0.102 | 5.2 | 93.66 | 4.55 | 1.79 | 78.06 | 13.33 | 9.61 |
| 7 | 6.0 | 0.500 | 0.102 | 5.2 | 93.98 | 4.20 | 1.81 | 59.41 | 11.06 | 29.54 |
| 8 | 2.0 | 0.500 | 0.102 | 5.5 | 91.90 | 4.13 | 3.97 | 65.12 | 27.48 | 7.40 |
| 9 | 4.0 | 0.250 | 0.034 | 5.2 | 91.44 | 4.86 | 3.70 | 78.78 | 12.28 | 8.94 |
| 10 | 6.0 | 0.250 | 0.068 | 5.2 | 93.07 | 5.02 | 1.91 | 67.79 | 9.78 | 22.43 |
| 11 | 4.0 | 0.250 | 0.102 | 5.3 | 94.16 | 4.10 | 1.74 | 77.98 | 14.66 | 7.37 |
| 12 | 2.0 | 0.250 | 0.068 | 5.7 | 92.79 | 3.69 | 3.52 | 59.86 | 33.90 | 6.24 |
| 13 | 4.0 | 0.500 | 0.068 | 5.2 | 93.56 | 4.61 | 1.83 | 70.34 | 10.17 | 19.50 |
| 14 | 4.0 | 0.125 | 0.068 | 5.2 | 94.16 | 4.28 | 1.56 | 74.21 | 18.17 | 7.62 |
| 15 | 4.0 | 0.250 | 0.068 | 5.2 | 94.57 | 3.84 | 1.58 | 77.43 | 14.19 | 8.38 |

As can be seen from Table 111, the best results were obtained from the reagent concentrations used in test run Nos. 15, 11, 6, 14 and 13, ranked in order of performance. These rankings are based upon the recovery of the copper in the copper rougher concentrate and of the molybdenum in the molybdenum rougher concentrate.

EXAMPLE 4

Example 3 was repeated using a different copper-molybdenum ore from the southwest United States. As indicated in the following Table IV, a series of test runs were made using various amounts of $S_2$, starch and "Flotezol 150" as a collector. The results obtained are set forth in Table IV:

TABLE IV

| Test No. | REAGENTS-LBS PER TON ORE SO2 | Starch | Flotezol 150 | Cu Flot pH | METAL DISTRIBUTIONS % Cu in Cu Rgh | % Cu in Mo Rghs | % Cu in Tail | % Mo in Mo Rghs | % Mo in Cu Rgh | % Mo in Tail |
|---|---|---|---|---|---|---|---|---|---|---|
| 1 | 2.0 | 0.125 | 0.034 | 5.9 | 86.74 | 6.76 | 6.50 | 48.74 | 30.52 | 20.74 |
| 2 | 6.0 | 0.125 | 0.034 | 5.3 | 86.52 | 7.65 | 5.83 | 55.34 | 30.77 | 13.90 |
| 3 | 6.0 | 0.500 | 0.034 | 5.3 | 87.38 | 7.18 | 5.44 | 61.28 | 24.31 | 14.41 |
| 4 | 2.0 | 0.500 | 0.034 | 5.9 | 87.65 | 6.04 | 6.30 | 46.53 | 30.74 | 22.73 |
| 5 | 2.0 | 0.125 | 0.102 | 5.8 | 86.68 | 7.44 | 5.88 | 52.49 | 31.09 | 16.42 |
| 6 | 6.0 | 0.125 | 0.102 | 5.4 | 86.26 | 7.74 | 5.99 | 24.30 | 58.72 | 16.97 |
| 7 | 6.0 | 0.500 | 0.102 | 5.4 | 87.47 | 7.50 | 5.04 | 31.28 | 52.85 | 15.87 |
| 8 | 2.0 | 0.500 | 0.102 | 5.9 | 86.91 | 7.03 | 6.03 | 46.94 | 30.40 | 22.66 |
| 9 | 4.0 | 0.250 | 0.034 | 5.6 | 77.38 | 15.61 | 7.03 | 51.10 | 28.15 | 20.75 |
| 10 | 6.0 | 0.250 | 0.068 | 5.4 | 87.53 | 6.54 | 5.93 | 36.91 | 46.15 | 16.94 |
| 11 | 4.0 | 0.250 | 0.102 | 5.5 | 86.69 | 7.19 | 6.11 | 22.11 | 59.73 | 18.17 |
| 12 | 2.0 | 0.250 | 0.068 | 5.8 | 86.97 | 6.62 | 6.41 | 46.44 | 29.11 | 24.44 |
| 13 | 4.0 | 0.500 | 0.068 | 5.5 | 87.84 | 6.94 | 5.22 | 36.47 | 46.69 | 16.84 |
| 14 | 4.0 | 0.125 | 0.068 | 5.5 | 87.33 | 7.19 | 5.49 | 28.38 | 54.14 | 17.47 |
| 15 | 4.0 | 0.250 | 0.068 | 5.5 | 87.23 | 7.37 | 5.40 | 35.76 | 51.06 | 13.18 |

As can be seen from Table IV, the best results were obtained from the reagent concentrations used in test run Nos. 3, 4, 13 and 10, ranked in order of performance. These rankings are based upon the recovery of the copper in the copper rougher concentrate and of the molybdenum in the molybdenum rougher concentrate.

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. In a sequential flotation process for the separation of components of an ore containing sulfides of copper and molybdenum wherein said ore is routed sequentially through a series of flotation circuits having separation and concentration stages for separating and concentrating the components of said ore, the improvement comprising: initially effecting selective flotation of the copper component directly from said ore by conditioning the ore with a combination of a source of bisulfite ion and causticized starch to produce a conditioned ore having a pH approximately 5.2 and 6.2 to depress the molybdenum component and promote the copper component and thereafter treating the conditioned ore with a copper selected from the group consisting of alkyl dithiophosphinates and dialkyl dithiophosphates and subjecting the treated, conditioned are to said selective flotation to yield a concentrate of said copper component and a flotation tailings of said depressed molybdenum component.

2. A process as set forth in claim 1 wherein said pH is between approximately 5.2 and 5.6.

3. A process as set forth in claim 1 wherein said collector is a blend of diisobutyl, diisoamyl and di n-pentyl dithiophosphates.

4. A process as set forth in claim 1 Wherein said source of bisulfite ion is sulfur dioxide present in an amount between approximately 2 and 6 pounds per ton of ore.

5. A process as set forth in claim 1 wherein said causticized starch is present in an amount between approximately 0.2 and 0.5 pounds per ton of ore.

6. A process for selectively and sequentially recovering a copper concentrate and a molybdenum concentrate from an ore containing sulfides of copper and molybdenum and being substantially free of soluble copper compounds which comprises the steps of:

(a) grinding a mixture of said ore and water to produce a slurry;

(b) conditioning said slurry with a combination of a source of bisulfite ion and causticized starch to depress molybdenum and promote copper flotation, said conditioned slurry having a pH between approximately 5.2 and 6.2;

(c) adding to the conditioned ore a frother and a copper collector selected form the group consisting of alkyl dithiphosphinates and dialkyl dithiophosphates;

(d) subjecting the conditioned ore containing said frother and collector to froth flotation to produce a copper rougher concentrate and a molybdenum tailing;

(e) conditioning said copper rougher concentrate with starch to depress residual molybdenum and subjecting said conditioned copper rougher concentrate to a cleaner flotation to produce a copper concentrate;

(f) conditioning the molybdenum tailing from the froth flotation in step (d) with a molybdenum collector and subjecting said conditioned tailing to a flotation to produce a molybdenum (g) conditioning the second flotation tailing with kerosene, pine oil and a molybdenum collector, subjecting the conditioned second flotation tailing to a third flotation to yield a second molybdenum concentrate, and combining said molybdenum rougher concentrate with said second molybdenum concentrate to yield a combined molybdenum concentrate; and (h) subjecting said combined molybdenum concentrate to a fourth flotation to produce a final molybdenum concentrate.

7. A process as set forth in claim 6 wherein said pH in step (b) is between approximately 5.2 and 5.6.

8. A process as set forth in claim 6 wherein said collector in step (b) is a blend of diisobutyl, diisoamyl and di n-pentyl dithiophosphates.

9. A process as set forth in claim 6 wherein said source of bisulfite ion in step (b) is sulfur dioxide present in an amount between approximately 2 and 6 pounds per ton of ore.

10. A process as set forth in claim 6 wherein said causticized starch in step (b) is present in an amount between approximately 0.2 and 0.5 pounds per ton of ore.

11. A process as set forth in claim 6 wherein said molybdenum collector in step (f) is a an allyl amyl xanthic ester collector.

12. A process as set forth in claim 6 wherein zinc cyanide is added during step (h).

* * * * *